United States Patent [19]

Wijma et al.

[11] Patent Number: 4,811,484

[45] Date of Patent: Mar. 14, 1989

[54] DRY-SHAVING APPARATUS

[75] Inventors: Willem S. Wijma, Drachten; Eduard W. Tietjens, Eindhoven; Eppe Bakker; Albert Hoekstra, both of Drachten, all of Netherlands

[73] Assignee: U.S. Philips Corp., New York, N.Y.

[21] Appl. No.: 205,600

[22] Filed: Jun. 8, 1988

Related U.S. Application Data

[63] Continuation of Ser. No. 943,479, Dec. 16, 1986, abandoned.

[30] Foreign Application Priority Data

| | | | |
|---|---|---|---|
| Dec. 20, 1985 | [NL] | Netherlands | 8503519 |
| Dec. 20, 1985 | [NL] | Netherlands | 8503520 |
| Dec. 20, 1985 | [NL] | Netherlands | 8503521 |
| Oct. 17, 1986 | [NL] | Netherlands | 8602606 |

[51] Int. Cl.[4] ..... B26B 19/14

[52] U.S. Cl. ..... 30/43.6; 30/346.51

[58] Field of Search ..... 30/43.4–43.6, 30/43.9, 43.92, 346.51

[56] References Cited

U.S. PATENT DOCUMENTS

| | | | |
|---|---|---|---|
| 2,292,931 | 8/1942 | Dicke | 30/43.6 X |
| 2,323,745 | 7/1943 | Wildeboor | 30/43.6 |
| 2,890,522 | 6/1959 | Bulova et al. | 30/43.6 X |
| 3,710,442 | 1/1973 | Meyer | 30/43.6 |
| 4,707,915 | 11/1987 | Bakker et al. | 30/43.6 |

*Primary Examiner*—Douglas D. Watts

*Attorney, Agent, or Firm*—Ernestine C. Bartlett

[57] ABSTRACT

A dry-shaving apparatus comprises a housing; a longitudinally extending shear plate; a holder for the shear plate, the holder being removable from the housing; and a longitudinally extending cutter rotatable relative to the shear plate. The cutter includes a carrier having cutting elements movable in a substantially radial direction relative to the carrier. Each cutting element has a cutting edge at its radial end, such radial ends being in contact with the shear plate during only a part of a revolution of the cutter and being clear of other parts of the apparatus during another part of the cutter revolution. A guide wall provided on the housing adjoins the shear plate, the radial ends of the cutting elements also being in contact during a further part of the cutter revolution with such guide wall.

2 Claims, 2 Drawing Sheets

DRY-SHAVING APPARATUS

FIELD OF THE INVENTION

This is a continuation of application Ser. No. 943,479, filed Dec. 16, 1986, now abandoned.

This invention relates to a dry-shaving apparatus comprising a housing, a holder for a shear plate, which holder is removable from the housing, and a cutter which is rotatable relative to the shear plate and which comprises a carrier having cutting elements which are movable in a substantially radial direction relative to the carrier and each of which has a cutting edge at its radial end, said radial ends being in contact with the shear plate during only a part of a revolution of the cutter and being clear of other parts of the apparatus during another part of the cutter revolution.

BACKGROUND OF THE INVENTION

Such a dry-shaving apparatus is known, for example from U.S. Pat. No. 3,710,442. During a revolution of the cutter each cutting element rather abruptly comes into contact with the shear plate and shortly thereafter this contact ends. In general this gives rise to undesired vibrations in the apparatus, which may result in damage to said cutter, to the shear plate and to other parts of the apparatus. Therefore, it is important that the shear plate has zones of such a shape that the most uniform "landing" and "departure" of the cutting elements are assured. Between these two zones the shear plate has a portion provided with hair-entry apertures for the shaving function, which portion should also meet specific requirements with respect to its shape. However, the shear plate is generally constructed as a flexible perforated metal foil which is detachably secured to the holder at a few points. When such a construction is used it is difficult to meet said requirements imposed on the shear plate with respect to its shape.

Moreover, the shear plate can cover a maximum circumferential angle of only 180°, because otherwise the holder with the shear plate is no longer detachable from the cutter. This also imposes restraints on the shape of the shear plate.

SUMMARY OF THE INVENTION

It is the object of the present invention to mitigate said problems and to this end the invention is characterized in that the housing is provided with a guide wall which adjoins the shear plate and with which the radial ends of the cutting elements are also in contact during a further part of the revolution of the cutter.

DESCRIPTION OF THE DRAWINGS

The invention will now be described in more detail with reference to the accompanying drawings, in which.

DETAILED DESCRIPTION OF THE PREFERRED EMBODIMENTS

Figure 1:
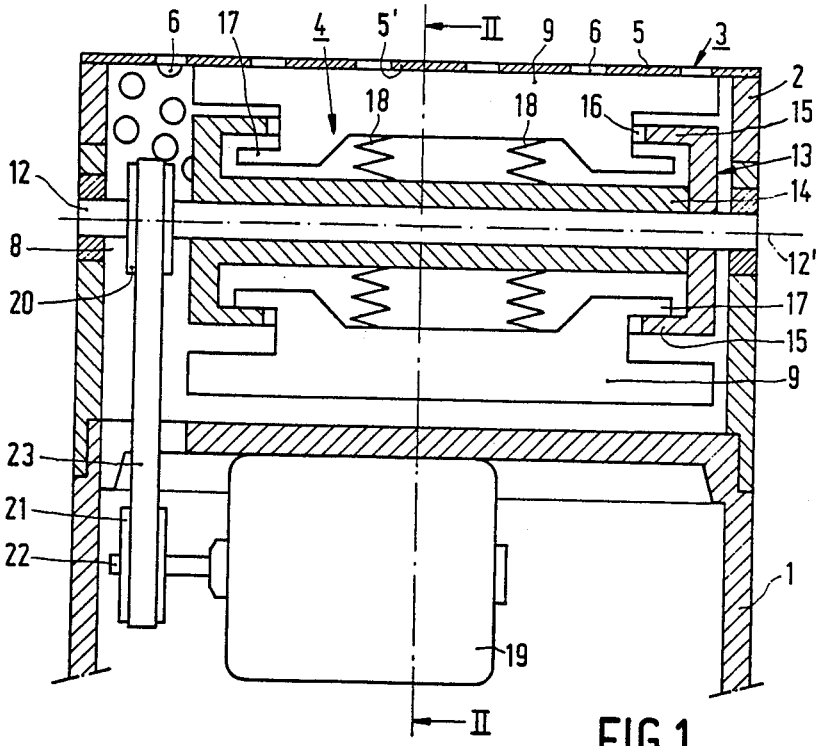
FIG. 1 is a diagrammatic longitudinal sectional view of a dry-shaving apparatus in accordance with the invention.
Figure 2:
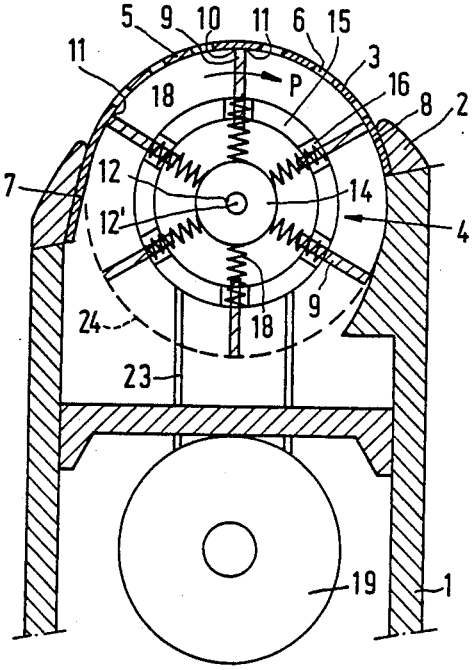
FIG. 2 is a sectional view taken on the line II—II in FIG. 1.

The dry-shaving apparatus shown in FIGS. 1 and 2 comprises a housing 1 with a detachable holder 2 for a longitudinally extending shear plate 3 and a longitudinally extending cutter 4 which is rotatable relative to the shear plate.

The shear plate 3 comprises a central portion 5 formed with hair entry apertures 6 and also comprises a first peripheral portion 7 and a second peripheral portion 8 which adjoin the central portion 5 and by which the shear plate is attached to the holder 2.

The cutter 4 includes cutting elements 9 each having a cutting edge 11 at its radial end 10. The cutter 4 has a shaft 12 which is rotatably supported in the housing and which is partly surrounded by the shear plate 3. During rotation of the cutter 4 hairs which protect inwards through the hair-entry apertures 6 are severed by cooperation between the portion 5 of the shear plate 3 and the cutting edges 11 on the ends 10 of the cutting elements 9 which slide over the inner surface 5' of the portion 5.

The cutter 4 includes a carrier 13 for the cutting elements 9, which carrier comprises a hub 14 and a cylindrical portion 15 with slots 16. The hub 14 is secured to the shaft 12. The cutting elements 9 are situated partly within the slots 16 and are radially movable over a limited distance relative to the carrier. The hook-shaped ends 17 of the cutting elements are situated between the hub 14 and the cylindrical portion 15 to prevent the cutting elements 9 from falling out of the carrier 13. Compression springs 18 are arranged between the hub 14 and the cutting elements 9 to exert outwardly directed radial forces on the cutting elements 9.

The housing 1 accommodates an electric motor 19 for driving the cutter 4, for example in a direction of rotation as indicated by the arrow P (FIG. 2). The rotation of the motor 19 is transmitted to the cutter 4 by means of pulleys 20 and 21 on the shaft 12 and on the motor shaft 22 respectively and a drive belt 23.

During a part of the revolution of the cutter 4 the end 10 of a cutting element 9 is clear of other parts of the apparatus. This situation obtains, for example, for the cutting elements 9, which are situated at a level below the shaft 12 in FIGS. 1 and 2.

Figure 3:
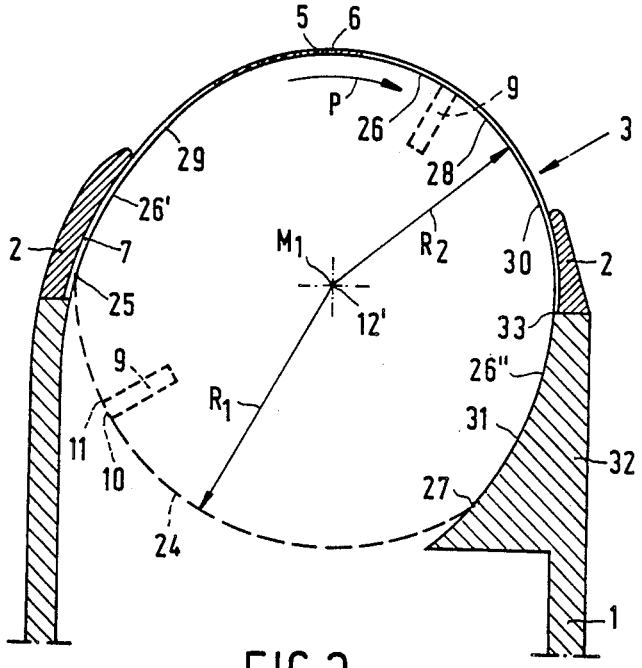
FIG. 3 is a simplified enlarged-scale sectional view similar to that shown in FIG. 2.

The compression springs 18 urge such a cutting element 9 as far as possible outwards relative to the carrier 13, causing the hook-shaped ends 17 to engage against the cylindrical portion 15. As the cutter 4 rotates about the axis of rotation 12', the free path which in this situation is followed by the cutting edge 11 on the end 10 of the cutting element may be defined as a cylindrical surface which in a sectional view as shown in FIG. 2 may be represented as an arc of circle 24 whose centre is situated on the axis of rotation 12' (FIG. 3). When the free path is followed there will be no frictional losses between the ends of the cutting element and other parts of the apparatus, which is an advantage in particular in view of the minimal power consumption of the apparatus.

FIG. 3 is a sectional view which corresponds to that of FIG. 2 and which diagrammatically and on an enlarged scale shows a part of the housing 1, the holder 2 and the shear plate 3. Two cutting elements 9 are shown in broken lines. During rotation of the cutter 4 the end 10 of a cutting element 9 contacts the first peripheral portion 7 of the shear plate 3 at point 25. Subsequently, the cutting edge 11 of this end 10 will follow a constrained path 26, which changes into the free path 24 at point 27.

A part of the constrained path of a cutting edge 11 is defined by the central portion 5 of the shear plate 3 and if this portion of the shear plate is curved in conformity with a circularly cylindrical surface it may be represented as an arc of circle 28 between points 29 and 30. If the centres of the arcs 24 and 28 coincide in $M_1$ on the axis of rotation 12' but the radius $R_1$ of the arc of circle 24 is larger than the radius $R_2$ of the arc of circle 28, the springs 18 are compressed over a constant length as a cutting edge 11 follows the part 28 of the constrained path 26. As this part 28 is followed the cutting elements 9 are consequently urged against the inner side of the shear plate with a constant pressure.

The sudden contact between an end 10 of a cutting element 9 and the shear plate 3 at point 25 may be regarded as a collision, producing vibrations which may impair correct performance of the apparatus and may give rise to damage. These collisions may also give rise to substantial forces between the shear plate and the cutting element, which may also give rise to damage. These large forces may occur in particular if the cutting elements 9 are mounted in the carrier 13 in a self-biasing or self-locking manner, which are techniques commonly used in dry-shaving apparatuses. Therefore, it is essential to provide a most uniform transition from the free path to the constrained path for a cutting element, so as to minimize said collision effects and the adverse consequences thereof.

At the transition from the free path 24 to the contrained path 26 and vice versa a cutting element is subjected to a displacement in a radial direction as a result of the different diameters of these paths, which gives rise to additional inertial forces, referred to as Coriolis forces, being exerted on the cutting elements. These Coriolis forces disturb the uniform motion of the cutter and hence the proper performance of the apparatus.

For a uniform transition from the free path to the constrained path and for minimal Coriolis forces it is important that the transitional portions between the points 25 and 29 and between points 27 and 30 have an adequate length.

In the embodiment shown in FIG. 3 the housing is provided with a guide wall 31 which adjoins the shear plate 3 and with which the end of a cutting element is also in contact during a further part of a revolution of the cutter. This guide wall 31 forms part of a portion 32 of the housing 1 and defines a part of the transitional portion 26" between the points 27 and 30.

In order to be detachable the shear plate 3 should not enclose the cutter 4 over a circumferential angle of more than 180°. This limits the dimensions of the shear plate in the direction of driving P, which restricts the dimensions of the constrained path defined by the shear plate. However, this restraint is overcome by means of the guide wall 31 which is constructed as part of the portion 32 of the housing 1 which adjoins the detachable holder 2. Moreover, the manufacturing technologies adopted for the housing, which is generally made of a plastic, provide ample possibility of optimizing the shape of the guide wall 31 and hence of the portion of the constrained path defined by this guide wall. For example, the sectional view of FIG. 3, the guide wall 33 between point 27 and point 31 where the guide wall adjoins the shear plate 3, may be shaped as an arc of a circle extending through points 27 and 33 and having a radius of a magnitude between $R_1$ and $R_2$.

In this embodiment the larger part of the shear plate 3 is available for defining the transitional portion 26' between points 25 and 29 and for the central portion 5 with the hair-entry apertures 6.

Figure 4:
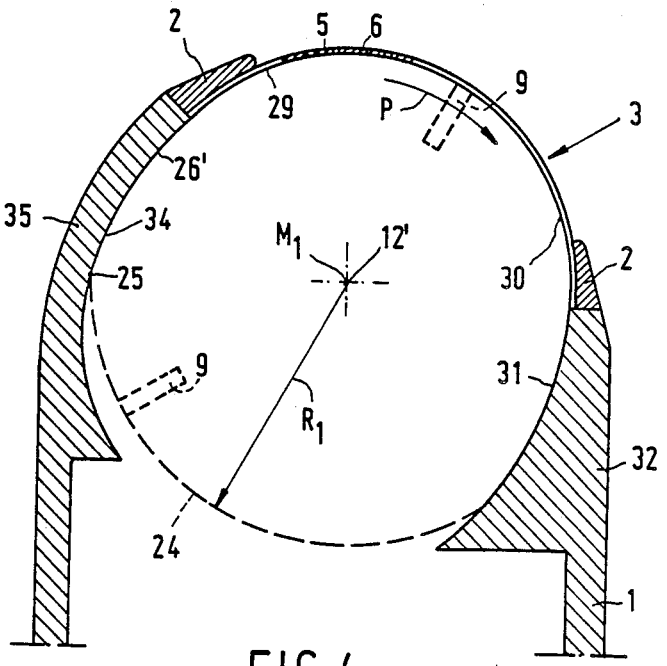
FIG. 4 is a simplified enlarged-scale sectional view of another embodiment, taken in the same way as that in FIG. 2.

FIG. 4 shows an embodiment comprising the same parts as the embodiment in FIG. 3 and having a second guide wall 34 forming part of the portion 35 of the housing. The guide walls 31 and 34 are situated on opposite sides of the cutter and both adjoin the shear plate 3. The guide wall 34 defines a part of the transitional portion 26' between the points 25 and 29 of the constrained path. The advantages described for the guide wall 31, i.e. the possibility of constructing the guide wall independently of the shear plate 3 with respect to its shape and dimensions also apply to the guide wall 34. It is also possible to select other types of material for the guide walls than the material of the housing, for example the housing portions 32 and 35 may be provided locally with a sheet or foil material. In this way the material for the guide walls 31 and 34 may be chosen so as to be impact-resistant, to produce low frictional losses, and to cause minimal wear.

What is claimed is:

1. A dry-shaving apparatus comprising a housing; a longitudinally extending shear plate; a holder for the shear plate, said holder being removable from the housing; a longitudinally extending cutter rotatable relative to the shear plate and including a carrier having cutting elements movable in a substantially radial direction relative to the carrier; the shear plate having a central portion shaped as a part of a circularly cylindrical surface and two peripheral portions respectively adjoining the central portion; the shear plate having a first transition between one peripheral portion and its central portion, a cutting edge of each cutting element at its radial end changing from a free path to a constrained path in the vicinity of the first shear-plate transition, and having a second shear-plate transition between the other peripheral portion and its central portion, a cutting edge of each cutting element at its radial end changing from a constrained path to a free path in the vicinity of the second shear-plate transition; each cutting element having a cutting edge at its radial end, and at least one guide wall provided on the housing and adjoining the shear plate forming a part of at least one transition between said constrained and free path, the radial ends of the cutting elements also being in contact during a further part of the cutter revolution with said guide wall whereby cutting elements enter and leave the transitions reducing the effects of collisions between the cutting elements and the shear plate.

2. A dry-shaving apparatus according to claim 1, in which the housing has guide walls adjoining the shear plate on opposite sides of the rotatable cutter forming a part of the transition between the constrained path to the free path and the transition between the free path to the constrained path.

* * * * *